United States Patent [19]

Cooke

[11] 4,263,707

[45] Apr. 28, 1981

[54] METHOD OF ACTUATOR ROD MANUFACTURE

[75] Inventor: Arnold Cooke, Bristol, England

[73] Assignee: Bendix Westinghouse Limited, Bristol, England

[21] Appl. No.: 18,902

[22] Filed: Mar. 9, 1979

[30] Foreign Application Priority Data

Mar. 16, 1978 [GB] United Kingdom ..... 10422/78

[51] Int. Cl.[3] ..... B21D 39/00; B23P 11/00

[52] U.S. Cl. ..... 29/509; 29/522 R; 403/274

[58] Field of Search ..... 29/509, 522 R; 403/274, 403/384, 387

[56] References Cited

U.S. PATENT DOCUMENTS

| | | | |
|---|---|---|---|
| 2,105,119 | 1/1938 | Hindes | 29/522 R UX |
| 2,376,397 | 5/1945 | Spencer | 29/522 R UX |
| 2,976,562 | 3/1961 | Black | 29/522 R X |
| 2,987,752 | 6/1961 | Black | 29/522 R X |
| 3,924,317 | 12/1975 | Becker | 29/522 R X |

FOREIGN PATENT DOCUMENTS

| | | | |
|---|---|---|---|
| 215866 | 5/1924 | United Kingdom | 29/522 R |

*Primary Examiner*—Charlie T. Moon

*Attorney, Agent, or Firm*—Larson, Taylor and Hinds

[57] ABSTRACT

A method of producing pneumatic brake actuator rods in which a spigot is provided at one end for mounting a pressure plate and a thread is provided on the output end, the body of the rod around the root of the spigot being under cut and thereafter upset by roll-swaging or other means to produce a flange for supporting the rod against the pressure plate so that the rod can be of generally substantially reduced diameter in relation to that used for many years hitherto.

10 Claims, 5 Drawing Figures

Figure 5:
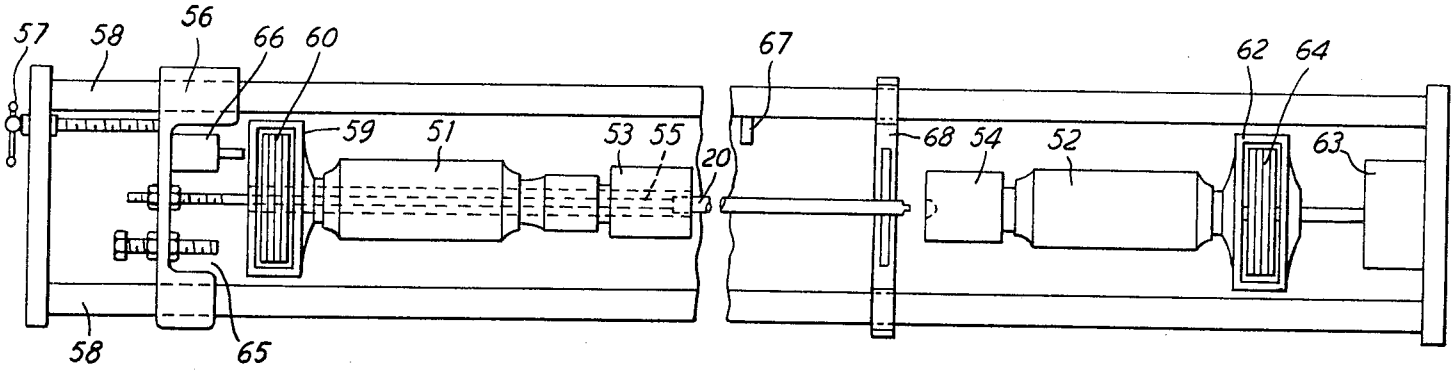

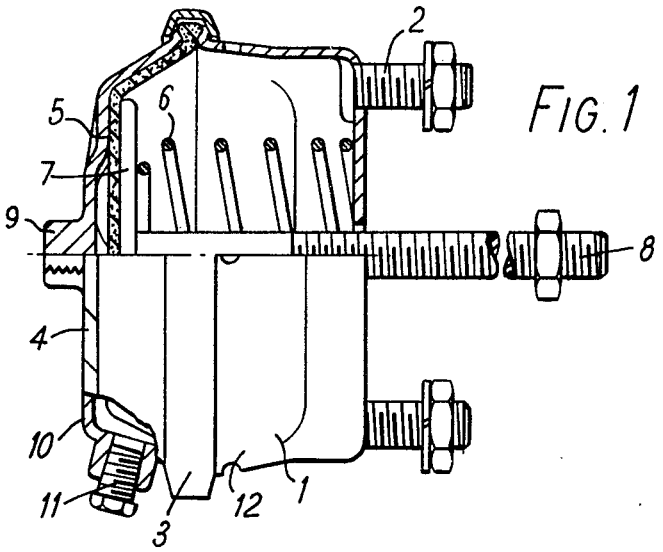
FIG. 1
FIG. 2
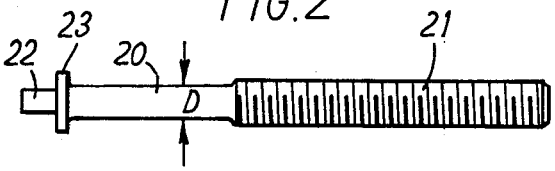
FIG. 3
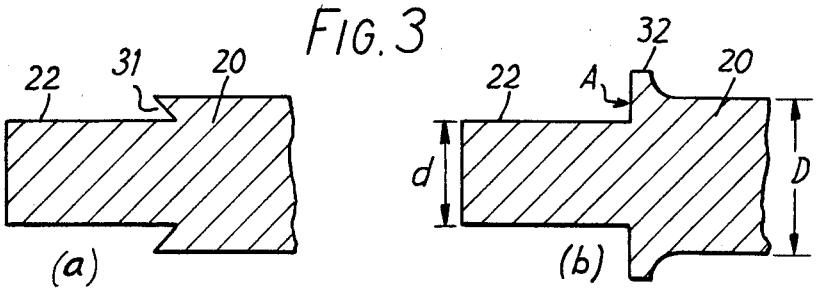
FIG. 4
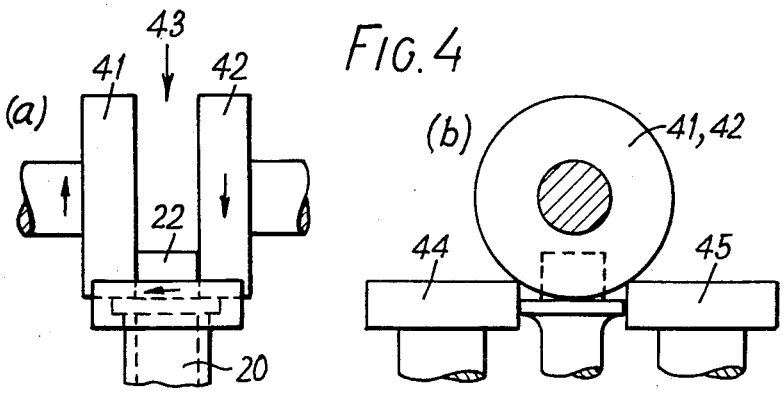

METHOD OF ACTUATOR ROD MANUFACTURE

This invention relates to actuator rod manufacture and relates especially but not exclusively to the manufacture of actuator rods of vehicle fluid pressure-operable spring brake actuators.

In vehicle fluid pressure-operable brake actuators, it is well known to provide a fluid pressure-responsive diaphragm which, when pressurised, acts against a pressure plate mounted on the inward end of a rod extending outwardly of the actuator. The connecting rod thus operates to transmit to vehicle brakes a braking force applied to the rod via the pressure plate. The pressure plate is therefore mounted by riveting or otherwise fixing to a spigot on the inward end of the rod and it is necessary not only that the spigot shall be sufficiently robust but also more especially that a sufficiently large annular bearing face for the plate shall be provided laterally of the spigot. Assuming that the pressure plate is not to be excessively thickened, the diameter of the rod has hitherto for many years been determined by the required area of such annular bearing face. The outward end of the rod usually has a suitable screw thread cut thereon over a part of its length for the attachment of a clevis or other means for connecting the rod to the brake mechanism.

According to the present invention, there is provided a method of manufacturing an actuator rod comprising the steps of providing at one end of the rod a spigot of diameter which is less than that of the main body of the rod and characterised by thereafter upsetting the end of the rod to produce an enlarged surface area of the rod around said spigot and thereafter mounting a plate on said spigot bearing against said enlarged surface area.

The spigot may be formed by machining and the machining tool may be so angled that the end of the main body of the rod is undercut around the root of the spigot.

The upsetting of the end of the main body of the rod around the root of the spigot is achieved by exerting substantial forces between the rod and an upsetting tool mounted coaxially with the rod and providing relative rotation to the rod on the upsetting tool.

The upsetting tool may comprise a pair of hardened rollers against which the end of the main body of the rod rollingly bears whilst being rotated.

Means may be provided against which the upset formed on the end of the rod bears to determine the eventual outer diameter of the upset part.

The process for manufacturing the rod with the upset may incorporate means for rolling a suitable screw thread at the other end of the main body of the rod.

By virtue of the present invention, wherein on the one hand an upset is formed at the end of the main body of the rod surrounding the spigot and, if desired, a rolled thread is provided at the other end, the necessary diameter of the rod may be reduced, together with the cost of manufacture.

In order that the invention may be more clearly understood and readily carried into effect, the same will be further described by way of example, with reference to the accompanying drawings of which:

FIG. 1 illustrates a fluid pressure-operable brake actuator,

FIG. 2 illustrates a push rod for such an actuator manufactured in accordance with the present invention, FIG. 3 shows enlarged sectional views of the inward end of the push rod before and after roll-swaging to produce the push rod of FIG. 2, FIG. 4 illustrates plan and side views at (a) and (b) of the essential parts of a roll-swaging head for use in the manufacture of the push rod, and FIG. 5 illustrates in schematic form, a plan view of an adaptation of a machine tool for manufacturing actuator rods in accordance with a method employing the present invention.

Referring to FIG. 1, this shows a common form of fluid pressure-responsive brake actuator which has been designed to provide the actuating force to operate the road wheel brakes of commercial road vehicles. Nevertheless, such actuators can be employed in other pneumatic actuator applications.

The housing is formed of two pressed-steel parts, the main body part 1 is provided with mild-steel mounting studs 2 for mounting the actuator to a chassis or frame and the other part comprises an end plate 4 between the rim of which and a corresponding rim of the body part 1, a diaphragm 5 is clamped by a clamping ring 3. The actuator is maintained in the un-operated position shown by a return spring 6 under compression between the flat base of the body part 1 and a mild-steel pressure plate 7 riveted on a spigot on the inner end of a mild-steel actuator rod 8. The rod 8 has a suitable screw-thread formed over a length of the outward extending end for fitment to a suitable clevis for connection to the brakes or other mechanism to be operated. The region is contained between the end cap 4 and the diaphragm 5 is provided with an inlet port via a boss 9 which is conveniently concentric with the arrangement. In the arrangement shown, an alternative inlet boss 10 is provided and either 9 or 10 may be plugged by a plug 11. The housing part 1 is provided with vent apertures such as 12 whereby the right-hand side of the diaphragm is always maintained at or near atmospheric pressure.

The push rod 8 is normally formed with a spigot, as referred to above, which passes through a central aperture in the pressure plate 7 and is riveted over such as to present a smooth face to the rear side of the diaphragm 5. It is necessary that the diameter of the actuator rod 8 shall be sufficiently large for the spigot to be of sufficient diameter to enable a suitably strong riveting operation to be effected and also to leave a sufficiently large area of the inward end of the rod to bear against the right hand side of the pressure plate 7. In FIG. 2, there is shown an alternative actuator rod which may be used in place of the actuator rod 8 in the actuator of FIG. 1. This actuator rod has a main body diameter D which is appreciably less than the main body diameter of the push rod 8 and the threaded portion on the outward end is rolled to give an equivalent clearing diameter for the thread. The inward end is formed like the rod 8 with a spigot denoted by reference 22, the diameter of which is substantially the same as the pre-riveted spigot employed on the rod 8.

With such a diameter of spigot 22 and the reduced diameter D of the main body part 20 of the rod of FIG. 2, the surface area of the inward end of the main body 20 would provide insufficient bearing surface for a pressure plate such as 7 of FIG. 1 without the formed-up flange 23 formed on it to supplement the available area at the end of the inner end of the main body portion 20.

The present invention is mainly concerned with the manner of production of mild steel actuator rods such as shown in FIG. 2, and FIG. 3 shows enlarged views of the inner end of a rod of FIG. 2 during the manufacturing process. The rod is first taken from a standard machining process which provides the spigot 22 as shown at (a) of FIG. 3, but the machining process is modified to the extent that the cutting tool is angled to undercut the inward end of the main body part at the point 31, at the root of the spigot as shown in (a). By processing in a machine provided with a roll-swaging facility, the inward end of the main body part is up-set to produce a flange such as 32 in FIG. 3 (*b*), whereby the area A presented to a subsequently fitted pressure plate such as 7 of FIG. 1, may be more than twice the area which would otherwise be possible with the diameters (d) and D respectively of the spigot and main body part as shown.

Referring to FIG. 4, the transformation of the inner end of the actuator rod from the stage (a) to the stage (b) of FIG. 3, is achievable by employing a roll-swaging head employing a pair of upsetting rollers 41 and 42 mounted co-axially in the body of the head and offering the arrangement co-axially towards the push rod denoted by reference 20 with a pressure which in hydraulic terms may be of the order of up to 400 p.s.i. At the same time, the rod 20 and the roll-swaging head are relatively rotated and since the rollers 41 and 42 fit snugly on either side of the spigot 22, the effect on the shoulder 31 of FIG. 3(*a*) is to up-set the shoulder to produce the flange such as 32. Although not essential to the operation, a further pair of rollers, one of which is denoted by reference 44 and the other of which is denoted by reference 45, more clearly shown in FIG. 4(*b*), are provided freely rotatable with axes at right angles to the common axis of rollers 41 and 42 and so spaced as to determine the outer diameter of the upset flange 32 and prevent feathering of the outer edge thereof. All four rollers are contained within the single roll-swaging head.

Referring now to FIG. 5, the plan view shown therein is a downward view upon the bed of a rotating machine which, for convenience, may be regarded as being provided with a pair of rotary bearing stocks 51 and 52. The stock 51 carries a thread-rolling die 53 and the stock 52 carries a roll-swaging head 54 employing four rollers as described above with reference to FIG. 4. The spindle of the stock 51 is tubular to enable a fixed stop-rod 55 to pass therethrough, being fixed to a back-stop carrier 56 adjustable by a lead screw and handle 57. The back-stop carrier is slideable on two stout bars 58 which extend the full length of the machine.

Between the back-stop carrier 56 and the end-stock 51, there is a thrust cage 59 within which a machine drive pulley 60 is provided coupled to the rotating head-stock 51. By this means, the reaction of the adjustable back-stop is transmitted directly through the cage to the stock 51 and the thread-rolling die 53. A similar thrust cage 62 is provided between a fixed hydraulic cylinder 63 and the rotatable end-stock 52 to contain a further drive pulley 64 for driving the roll-swaging head 54.

In addition to having the central stop-rod 55 fixed to it, the back-stop carrier 56 is provided with an adjustable fixed stop 65 and an hydraulic ram 66, the purpose of which is to provide a starting thrust for the thread-rolling head 53. Additionally, along the travel of the rotatable stock 51, there is an adjustable over-run detector 67 which on being reached by the carriage of the stock 51, interrupts the supply to the motor (not shown) which drives the pulley 60. Further, the hydraulic cylinder 63 which operates as a roll-swaging ram, has an associated pressure-sensing arrangement which interrupts operation of the ram when a predetermined pressure is attained indicating that the resistance is such that the required up-setting of the flange on the inner end of the main body of the actuator rod has been produced.

In operation, the machine operator turns the rotatable stocks 51 and 52 to their most separated positions and inserts the actuator rod 20 in position as shown with the left hand end inserted in the thread-rolling head, the otherwise unsupported part resting in a slideable vice carrier 68. This vice carrier permits a small floating clearance having regard to the bars 58 for permitting entry of the spigot on the right hand end of the rod to enter the roll-swaging head. Initially, the operator starts the motor driving the pulley 60 and energises the hydraulic thread-start cylinder 66. The operation of the cylinder 66 produces a deflection of up to an inch before the rotation of the thread-rolling head 53 takes over the drive and leads itself onto the rod for the required distance until the rotary stock reaches an adjustable stop or the detector 67. Attainment of this position can automatically open the die-head and cuts off the drive to the pulley 60. Meanwhile the completion of the stroke of cylinder 66 initiates the operation of the hydraulic ram cylinder 63 and the drive to the pulley 64. The roll-swaging head is thereby automatically lead onto the spigot on the actuator rod being formed and the roll-swaging process takes place as described above, with reference to FIGS. 3 and 4, until a certain limit pressure is sensed by the pressure switch, the effect of which is to interrupt the drives to the pulley 64 and the cylinder 63. After such interruption, the cylinder 63 retracts carrying the roll-swage head to the start position. The operator returns the stock 51 to the left until a back-stop sensor associated with the adjustable stop 65 senses that the starting position has been regained. The operator is then able to unclamp the finished rod from the vice carrier 68 and attachment of the pressure plate such as 7 can be made as required for an actuator.

Whilst in the foregoing, the up-setting of the flange 32 (FIG. 3) on the actuator rod is effected by a roll-swaging head, this may equally be achieved albeit with substantial noise and vibration, by employing a rotating percussive tool in place of the roll-swaging head 54 mounted on the rotatable stock 52.

Although only described above in broad outline, the manufacturing method will be readily apparent to those skilled in the art and the extent to which the process is made automatic is purely a matter of choice for the production unit employing the present invention. It will be appreciated that pressure-sensitive switches and proximity-detecting switch devices suitable for use in initiating and stopping the several stages of operation, are well-known.

Having thus described our invention, what we claim is:

1. A method of manufacturing an actuator rod comprising the steps of providing at one end of the rod a spigot of diameter which is less than that of the main body of the rod and which extends to said one end of the rod, thereafter upsetting the end of the main body of the rod adjacent the spigot to produce an enlarged surface area of the rod around said spigot and then mounting and securing an actuator pressure plate on said spigot bearing against said enlarged surface area.

2. A method as claimed in claim 1, wherein the end of the actuator rod is undercut at the root of the spigot when forming the spigot.

3. A method as claimed in claim 1 or 2, wherein upsetting of the said end of the rod is performed by rotating the rod in relation to an upsetting tool.

4. A method as claimed in claim 3, wherein the upsetting tool is rotated while the rod is clamped in a fixed position.

5. A method as claimed in claim 3, wherein the upsetting tool comprises a means against which the said end is rollingly engaged.

6. A method as claimed in claim 3, wherein the upsetting tool includes further roller means with a rotation axis generally parallel with the rod for limiting the diameter of the upset part and reducing feathering thereof.

7. A method as claimed in claim 6, said roller means is a pair of rollers with said further roller means disposed between them.

8. A method as claimed in claim 3, wherein the upsetting tool comprises a rotating percussive tool.

9. A method as claimed in claim 1, further including the further step of rolling a thread extending along a portion of the rod from the other end thereof.

10. A method as claimed in claim 9, further including clamping of the rod between a drivable thread-rolling tool, and a roll-swaging tool, rolling said thread from one end, upsetting the other end to produce said enlarged surface area, withdrawing the thread-rolling tool and unclamping the rod.

* * * * *